United States Patent [19]

Walker

[11] 4,130,954

[45] Dec. 26, 1978

[54] IRON SELF-CLEAN VALVE ASSEMBLY

[75] Inventor: Wendell C. Walker, Alta Loma, Calif.

[73] Assignee: General Electric Company, Bridgeport, Conn.

[21] Appl. No.: 840,918

[22] Filed: Oct. 11, 1977

[51] Int. Cl.[2] ..... D06F 75/06

[52] U.S. Cl. ..... 38/77.83

[58] Field of Search ..... 38/77.1, 77.5, 77.8, 38/77.83; 137/543.17, 543.19, 543.21

[56] References Cited

U.S. PATENT DOCUMENTS

| | | | |
|---|---|---|---|
| 3,747,241 | 7/1973 | Davidson | 38/77.83 |
| 3,823,498 | 7/1974 | Davidson | 38/77.83 |
| 3,849,916 | 11/1974 | Davidson | 38/77.83 |
| 3,913,615 | 10/1975 | Cooper | 137/543.19 |

*Primary Examiner*—Henry S. Jaudon

*Attorney, Agent, or Firm*—John F. Cullen; George R. Powers; Leonard J. Platt

[57] ABSTRACT

A steam iron is disclosed having a water tank, steam generating soleplate, a guided water valve to start and stop water to the soleplate for steam generation, and a dumper valve in the bottom of the tank to suddenly empty the tank onto the soleplate to purge and clean the iron. To this conventional structure an improvement provides a unitary assembly of the dumper valve that includes a first smoothly continuous tubular member with its upper end connected to the bottom of the tank and its lower end extended below the tank towards the soleplate. Cooperating with this is a second smoothly continuous concentric tubular member telescopically disposed frictionally with the first member so the two tubes are pushed and locked together. Each of the members has an inwardly directed flange at one end and at the opposite end from the other so that the flanges define reduced openings at the upper and lower tubular ends. A movable flat valve disc spans the upper opening below its flange and a spring is provided below the disc to bias it closed whereby the structure provides a complete and entire assembled subunit that may be fixedly locked in the tank bottom and is movable to direct all the water straight through the tubular members to suddenly empty the iron.

5 Claims, 4 Drawing Figures

FIG. 1.
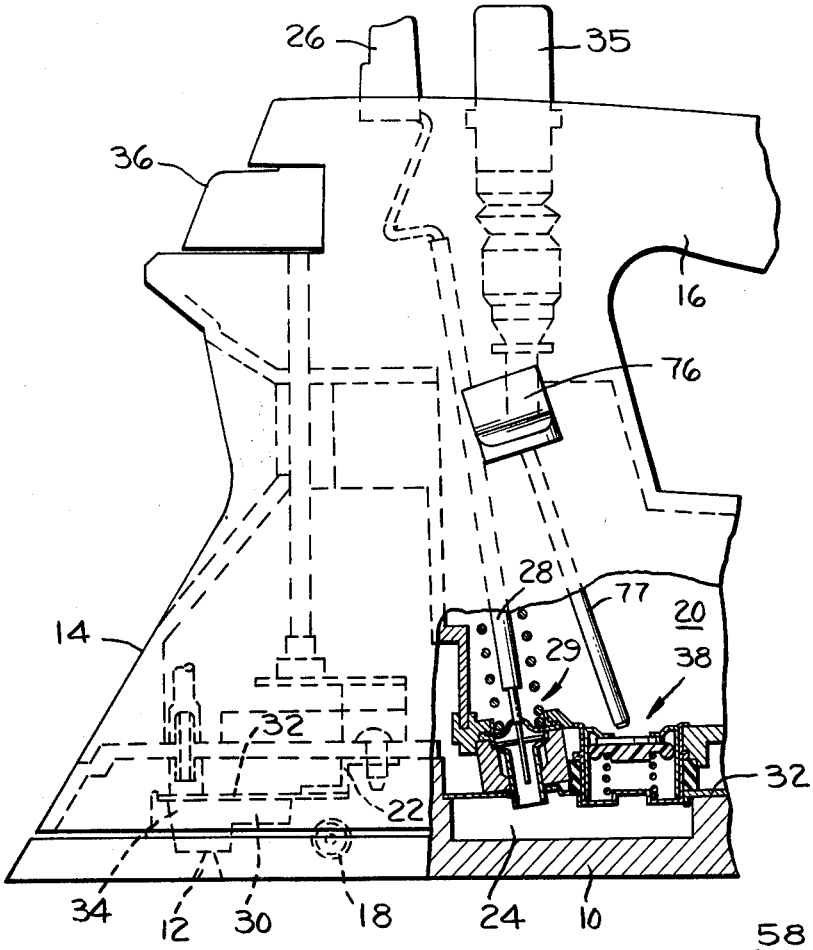
FIG. 2.
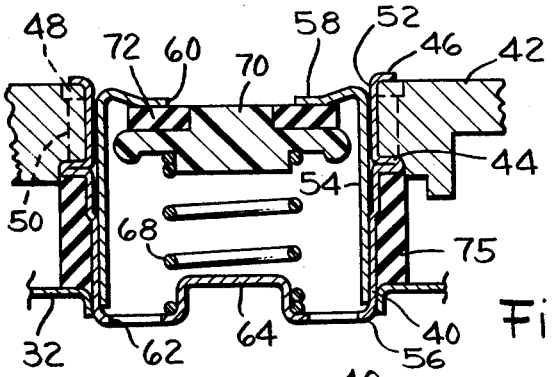
FIG. 4.
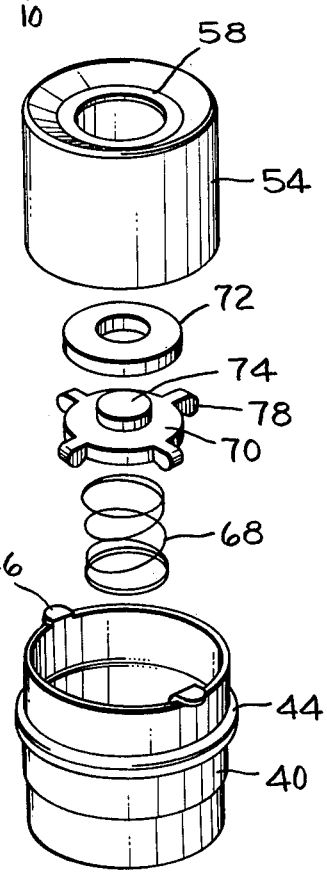
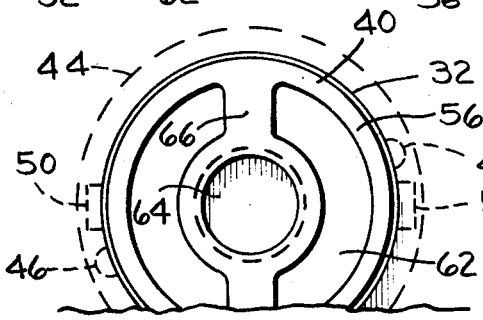
FIG. 3.

IRON SELF-CLEAN VALVE ASSEMBLY

BACKGROUND OF THE INVENTION

1. Field of the Invention

The invention herein pertains to a self-cleaning steam iron using a dumper valve to empty the tank suddenly onto the soleplate to purge the iron and, more particularly, to the structure of a preassembled subunit dumper valve assembly that is easily installed in the tank bottom.

2. Description of the Prior Art

In steam irons a water tank is used above the soleplate and a water valve structure provides controlled water drippage into the steam generator where it is flashed into steam and directed out soleplate ports to steam the article. Generally, the user is advised to use distilled water because of the fineness of various water passages and orifices which tend to clog due to mineral deposits from the water, which varies locally. In especially hard water localities, tap water contains minerals which produce loose flakes and deposits that plate out easily onto hot iron components. These are generally lime or calcium carbonate as well as other chemicals in solution or in a colloidal suspension. Self-cleaning irons have appeared such as shown in U.S. Pat. Nos. 3,747,241 and 3,823,498 both of common assignment where the tank water, by a dumper valve is suddenly emptied onto the hot soleplate and into the boiler generator respectively to purge and scrub out the iron prying out the loose deposits and other debris. Other designs blow an extra charge of high pressure steam through the soleplate ports cleaning only the ports. Part of the new self-cleaning concept of applicant's assignee includes cleaning the valve structure per se by a constant scraping action to remove deposits which are then carried out of the iron by the self-cleaning action of the 3,747,241 patent. The two together, purging the tank and passages plus the valve structure cleaning, have provided a self-cleaning iron with much longer life than previously obtainable. The scraping concept of the metering rod and orifice of the valve structure is disclosed in U.S. Pat. No. 3,496,661 of common assignment. The present invention is directed to an improvement in the dumper valve assembly to provide a unitary assembly of few parts that is self-contained and easily assembled as a complete subunit in an iron water tank.

SUMMARY OF THE INVENTION

Briefly described, the present invention is directed to specific structural improvements on the dumper valve structure of the 3,747,241 patent and is directed to a steam iron with an enclosed fillable water tank, steam generating soleplate, a guided water valve movable between an on/off position to direct water to the soleplate for steam generation, and a dumper valve in the tank bottom operable to suddenly empty the tank onto the soleplate to purge and clean the iron. To this conventional structure, the invention provides an improvement in the dumper valve assembly by forming a unitary subunit assembly that includes a first smoothly continuous tubular member fixedly disposed with its upper end connected to the bottom of the tank to extend below it with its lower end toward the soleplate, and a second concentric smoothly continuous tubular member that is telescopically disposed or pushed in tight frictional engagement with the first member to lock the two together. There is provided inwardly directed flange means at one end of each of the tubular members with the respective flange means being disposed at opposite ends from each other and defining reduced openings at the upper and lower ends of the telescoped smoothly continuous tubular members. A strut-supported central base is provided at the lower end of the first tubular member and a vertically movable valve disc spans the upper opening below its flange with spring means between the valve disc and the central base to bias the valve disc closed against the upper opening. Suitable additional flange structure spans the tank bottom at the top and bottom and a slight cam surface may be provided on the tank bottom whereby the entire fourpart dumper valve may be preassembled as a fixed subunit that can be easily assembled in the tank bottom of the iron. Thus, the main object of the invention is to provide a unitary preassembled subunit dumper valve assembly that uses few parts, that can be pretested before insertion in the iron, that has free flow therethrough for improved self-clean operation and this is easily connected to actuating structure within the iron.

BRIEF DESCRIPTION OF THE DRAWING

FIG. 1 is an elevational view, partially in section and broken away, showing the general parts of an iron and illustrating the invention;

FIG. 2 is an enlarged cross-sectional view of the preassembled dumper valve;

FIG. 3 is a bottom view of FIG. 2; and

FIG. 4 is an exploded perspective of the parts shown in FIG. 2.

DESCRIPTION OF THE PREFERRED EMBODIMENT

Referring to FIG. 1, there is shown an electric steam iron generally of the self-cleaning variety of the type shown in U.S. Pat. No. 3,747,241 supra. As such, the iron includes a soleplate 10 with a plurality of steam ports 12 and an outer shell 14 suitably connected or forming part of handle 16 in known fashion. Soleplate 10 conveniently may be cast from aluminum with an electric heating element 18 cast in position and disposed so uniform heat distribution is provided when the iron is plugged in and activated.

The iron includes means for generating steam by providing water tank 20 that may be part of a single plastic housing positioned by bracket 22 and other suitable mechanism in conventional fashion. for steam, soleplate 10 has a steam generator 24 into which, under control of button 26 and guided valve stem 28 movable between an on/off position, water controllably drips from tank 20 onto hot soleplate 10 through metering water valve 29 of the type in the 3,496,661 patent supra, the resulting steam being distributed through distributing passages 30 under a coverplate 32 and out ports 12 onto the fabric being ironed. In the embodiment shown, an additional surge is provided by injecting water into a separate forward generator 34 by control button 35. A temperature control 36 thermostatically controls the soleplate heat and all the structure described is generally well known.

One of the main features in the self-cleaning iron is provision for suddenly and completely dumping tank 20 onto the hot soleplate through a substantially large opening that preferably, although not necessarily, is spaced and separate from the usual water valve 29. Controlling this large opening, a dumper valve generally indicated at 38 and disposed in the bottom of the water tank operates to quickly empty the tank, onto the soleplate where the combination of hot water and steam suddenly created forcefully steams out and purges or cleans the internal passages, the tank, and the exit ports of lint and internal deposits. This structure is generally known and shown in U.S. Pat. No. 3,747,241.

The early versions of the dumper valve used numerous precision parts that had to be carefully assembled into the iron and then tested so that malfunctioning required complete disassembly and replacement.

The present invention is directed to a unitary preassembled dumper valve assembly that uses fewer parts, that permits a complete pretesting before assembly, that is free flowing to help clean itself and that is easily connected to the internal actuating structure of the iron. To this end, the valve is a unitary or subunit assembly that includes a first tubular member 40 that is preferably a smooth continuous cylindrical tube as seen in FIG. 4 and may be easily formed of thin metallic stock or molded in plastic. It is designed to be fixedly placed in the bottom wall 42 of the tank with its upper end substantially flush with the bottom of the tank and extending downwardly with its' lower end towards the soleplate as seen in FIGS. 1 and 2. Any suitable arrangement may connect the member 40 in the tank bottom such as outwardly formed flange members 44 to act as an upward stop against the bottom of tank wall 42 and a second axially spaced flange means that may be in the form of tabs 46 as shown in FIG. 3 which are bent over at the top of wall 42 so that the flanges span the tank bottom at the top and bottom there of to fixedly locate and lock tube 40 in the bottom wall. The tube is tightened in its opening by a suitable means such as a cam surface 48 formed on the upper surface of the tank bottom 42 and utilized by making the top flange in the form of any suitable number of spaced peripheral tabs 46 as shown in FIG. 3 which cooperate with suitable spaced slots 50 in the wall opening 42 whereby tubular member 40 may be slid in from the bottom of the tank and then rotated so that cooperation between flange tabs 46 and cam surface 48 tightens member 40 snugly into the bottom wall 42. It will be noted that outward flange 44 will thus be pulled tight against the tank bottom to partially seal vertical slots 50 with the result that tubular member 40 is snugly and permanently locked in position. For completing the valve, and cooperating with tubular member 40, there is provided a second smooth continuous concentric tubular member 54 (FIG. 4) that is telescopically pushed into tight frictional engagement perferably within the first member 40 by a press fit to lock the two together as shown in FIG. 2. Each of the tubular members 40 and 54 is provided with a respective, preferably radial inwardly directed flange 56 and 58 respectively with one flange at one end of each of the tubular members and disposed at opposite ends from each other as seen in FIG. 2. The flanges are designed to provide reduced openings 60 at the upper and 62 at the lower ends of the respective tubular members. In addition, first member 40 has a central circular base 64 connected by suitable struts 66 to the flange 56. In other words, flange 56 has a series of radial inward struts 66 that connect and support base 64 with wide openings between the struts for the passage of water. The central base 64 may be vertically offset to act as both base and locating means for biasing spring 68 which, in turn, presses against vertically movable valve disc 70 that spans the upper opening 60 below flange 58 and is peripherally spaced from tubular member 54 as seen in FIG. 2 thus closing the valve to the passage of any water. Suitable resilient means 72 which is nothing more than a washer may form part or be separately secured to the upper surface of valve disc 70 as by projection 74 to form a watertight seal with flange 58 at opening 60.

The entire five unit valve structure as shown in FIG. 4 (four if the valve disc and washer are one) may be completely and easily put together as a unitary subunit assembly of the type shown in FIG. 2. As shown, it uses inexpensive and easily manufactured formed parts and the entire subunit can be completely assembly and pretested before insertion in tank wall 42. When the subunit is assembled, it is merely inserted into bottom wall 42 of the tank which tank containing the valve is then placed against cover plate 32 to compress gasket 75 and form, with flange 44, a tight sealing position as shown in FIG. 2. The entire valve is operated through a dumper knob 76 on the side of the iron and actuating rod 77 that presses down on the top of the valve disc to open the valve against the spring bias for a sudden discharge of the tank water into the boiler 24 of the hot soleplate. No other connection is necessary and the dumper knob is merely inserted in an easy connection with its' actuating rod 77. The valve assembly may be formed with spaced projections 78 to allow for better and faster flow of water only straight through the entire valve assembly by the smooth continuous tubular members, past struts 66 and into boiler 24 resulting in free flow completely through the valve onto the hot soleplate for improved self-clean operation. Thus, the particular structure is an easily assembled subunit outside of the iron, is inexpensive, easily pretested, easily assembled and actuated without precise fittings and manufacturing tolerances all to enhance the self-clean operation with fewer and inexpensive parts.

While I have hereinbefore described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a steam iron having a water tank, steam generating soleplate, a guided water valve movable between an on/off positon to direct water to the soleplate for steam generation, and a dumper valve in the tank bottom operable to suddenly empty the tank onto the soleplate to purge and clean the iron, the improvement in said dumper valve comprising, a unitary assembly including, a flat smoothly continuous tubular member fixedly disposed with its upper end connected to the bottom of said tank and extending with its lower end towards the soleplate, a second concentric smoothly continuous tubular member telescopically disposed in frictional fixed engagement with said first member to lock the two together, radial inwardly directed flange means at one end of each of said tubular members and at opposite ends from each other, said flanges defining reduced openings at the tubular upper and lower ends, a vertically movable valve disc spanning the upper opening below its flange and peripherally spaced from said second tubular member, and spring means disposed against the lower flange and against said valve disc biasing said disc closed, whereby the dumper valve structure is an entire assembled subunit fixedly locked in the tank bottom with said disc movable to permit only straight flow through said tubular members to suddenly empty the iron.

2. Apparatus as described in claim 1 wherein said first tubular member has a strut-supported central base extending from its respective flange at the lower end thereof and said second tubular member has its respective flange at its upper end to define said upper opening, and said spring being disposed on the central base to bias said disc closed.

3. Apparatus as described in claim 2 wherein said valve disc has resilient means secured to the upper surface thereof to form a watertight seal with the flange of said second tubular member.

4. Apparatus as described in claim 3 wherein said first tubular member has axially spaced outwardly extending flange means spanning said tank bottom at the top and bottom thereof fixedly locating and locking said unitary subunit assembly in said tank bottom.

5. Apparatus as described in claim 4 wherein the top outwardly extending flange comprises spaced peripheral tabs, cam means on the upper surface of the tank bottom, whereby the complete subunit is rotated into the tank bottom with said tabs and cam pulling the bottom outward flange against the tank bottom to lock the subunit fixedly therein.

* * * * *